United States Patent [19]

Stewart

[11] Patent Number: 5,001,782

[45] Date of Patent: Mar. 26, 1991

[54] METHOD OF ALTERING AN ARTICLE OF CLOTHING

[76] Inventor: Kimberley A. Stewart, 531 E. Irving, Madison Heights, Mich. 48071

[21] Appl. No.: 536,019

[22] Filed: Jun. 11, 1990

[51] Int. Cl.[5] ..... A41D 27/08; A41D 27/10

[52] U.S. Cl. ..... 2/69; 2/243 R; 2/243 B; 2/243 A; 2/275; 2/274; 2/244

[58] Field of Search ..... 2/69, 243 R, 243 B, 2/243 A, 275, 274, 244

[56] References Cited

U.S. PATENT DOCUMENTS

Re. 33,215 5/1990 Sweet ..... 2/243 R 4,665,851 5/1987 Sweet ..... 2/243 R

*Primary Examiner*—Werner H. Schroeder
*Assistant Examiner*—Gloria Hale
*Attorney, Agent, or Firm*—Harness, Dickey & Pierce

[57] ABSTRACT

A method of altering an article of clothing which has the steps of: (a) making at least two cuts into the material of the article of clothing to form a strip of material of a predetermined length attached at both ends to the material; (b) cutting the strip to form a pair of strips with free ends; and (c) reattaching the pair of strips together to form an altered article of clothing. The article of clothing as altered is also disclosed.

15 Claims, 1 Drawing Sheet

METHOD OF ALTERING AN ARTICLE OF CLOTHING

BACKGROUND OF THE INVENTION

The present invention relates to a method of altering an article of clothing and the article of clothing produced thereby. More specifically, the present invention provides an improved and stylistic effective method for altering sweat shirts, pants and the like to provide a dimensionally altered stylistic final article of clothing.

In recent years, it has increasingly become fashionable to alter articles of clothing by providing rips, tears or other apertures or inconsistencies in clothing. In fact, fashion designers of today have gone to great lengths to provide such articles of clothing as they have become stylistically in demand.

Thus, due to this recent trend in clothing to provide such apertures and the like, there has been room for improvements which will not only provide such apertures and present a new design of an article of clothing but also will function to dimensionally alter the article of clothing.

Provided in the present invention is an improved method for altering an article of clothing which provides apertures and the like and also may be used to alter the dimensions of the clothing as desired in a particular design. In accordance with this new method, a stylistically modern type garment is provided, which also provides improved alteration functions.

SUMMARY OF THE INVENTION

According to the present invention there is provided a method of altering an article of clothing made from a sheet of material. The method of the present invention includes the steps of first making at least two cuts in the folded material for forming a strip of material of a predetermined length attached at both ends to the material. Next, the strip is cut to form a pair of strips having free ends. Thereafter, the free ends of the pair of strips are attached together to form the resulting altered article of clothing. Also provided in the present invention is an improved article of clothing made in accordance with these steps.

Thus, it is an object of the present invention to provide an alteration of an article of clothing. It is an advantage of the present invention in that an altered article of clothing may be provided while at the same time providing an aesthetically pleasing article of clothing in accordance with present fashions.

Additional benefits and advantages of the present invention will become apparent from the subsequent drawings taken in conjunction with the description of the preferred embodiment and appended claims.

DESCRIPTION OF A PREFERRED EMBODIMENT

In accordance with the present invention there is shown a method of altering an article of clothing 10. The sweat shirt 10 or other article of clothing is made from a sheet of material, such as cloth or the like, generally indicated at 12. The method is illustrated in more detail in FIGS. 2–4 and generally includes the steps of: (a) making at least two cuts into the material for forming a strip of material of a predetermined length attached at both ends to the material; (b) cutting the strip to form a pair of strips having free ends; and (c) attaching the pair of strips having free ends together to form an altered article of clothing.

Figure 2:
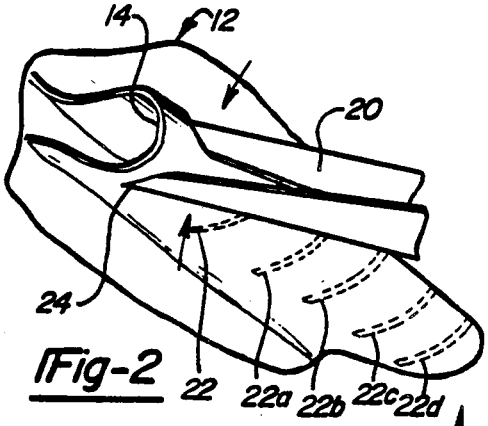
FIG. 2 is a detailed perspective view of an area of the article of clothing encompassed in the circular portion as shown in FIG. 1, showing a first step of a method in accordance with the teachings of the present invention.
Figure 3:
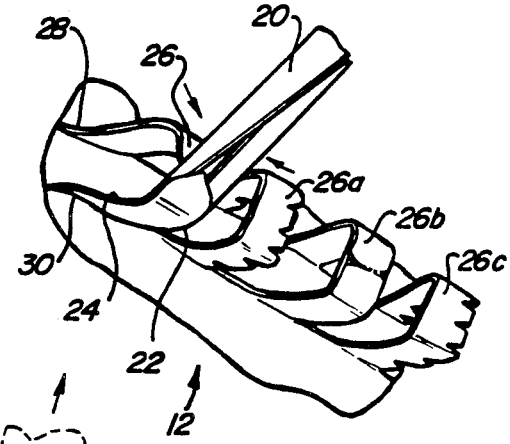
FIG. 3 is a perspective view showing a second step of a method in accordance with the teachings of the present invention.

Referring to FIG. 2, in a preferred embodiment of the first step of the present invention the material 12 is folded upon itself to form a crease-like portion 14. The crease 14 or the like may be provided on the arms 16 of the garment, on the body of the garment about the waist portion 18 or about the chest portion 20 as may be desired on a particular application.

After the crease portion 14 is formed in the material 12 a scissors 20 or other cutting tool may be utilized to provide at least a pair of slots such as 22 and 24. This produces a strip of material 26 which is attached to the fabric at its terminal ends 28 and 30. In a preferred embodiment, a plurality of cuts **22*a*, 22*b*, 22*c* and 22*d* are cut in the fabric to provide a plurality of strips 26*a*, 26*b* and 26*c* along the creased portion 14**.

The strip 26 is then cut to form a pair of free ends 32 and 34. This also forms pairs of strips attached at their base to the underlying material 12. In the embodiment shown, a preferred method of altering the article of clothing is provided by cutting alternate strips, such as **26*a* and 26*b* to provide such pairs of strips. However, other embodiments, such as cutting two in a row, such as shown in FIG. 5**, may be utilized without deviating from the scope of the present invention.

Figure 4:
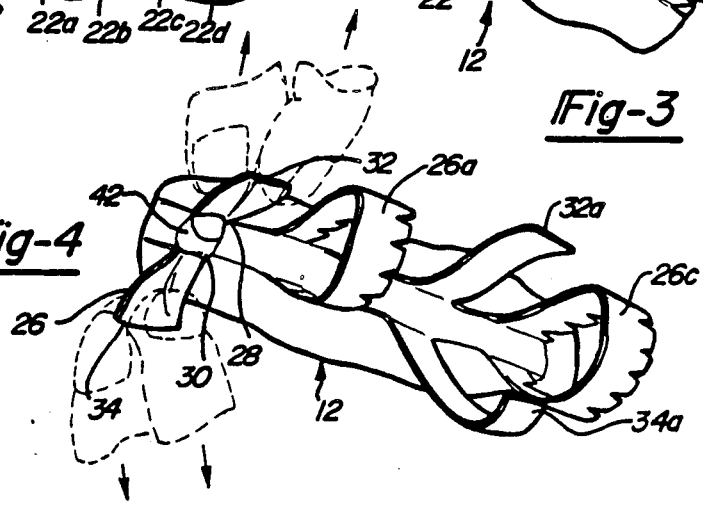
FIG. 4 is a perspective view showing a third and final step of a method in accordance with the teachings of the present invention.

In a final step of the present invention, the free end 32 and 34 are tied together in a knot, such as a square knot, to draw in the fabric adjacent to the base of the strips 28 and 30. Of course, other methods of attaching the strips together adjacent their base may be utilized without deviating from the scope of the present invention. Thus, as shown in FIG. 4, the ends 32 and 34 may be tied together and the pairs of ends **32*a* and 34*a* formed by cutting of strip 26*b* may be tied together allowing the portions 26*a* and 26*c*** to puff out and become a loop in the article of clothing.

Figure 1:
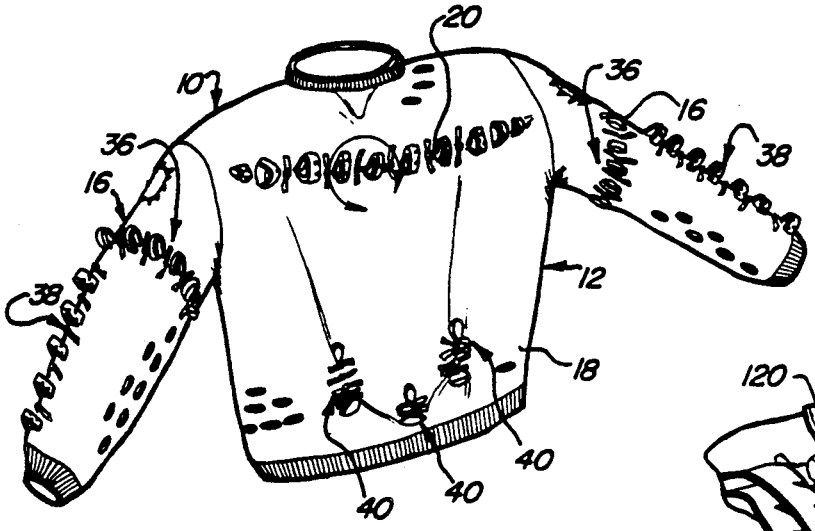
FIG. 1 is a perspective view of an altered article of clothing made in accordance with the teachings of the present invention.
Figure 5:
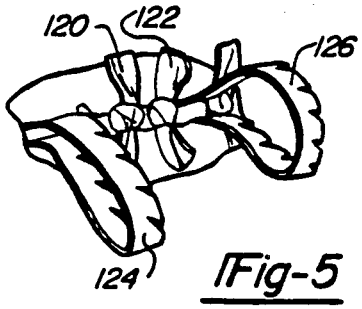
FIG. 5 is a perspective view showing an alternate method of altering an article of clothing in accordance with the teachings of the present invention.

As set forth above, and referring to FIG. 5, the method of the present invention includes the forming and tying of at least one strip in the article of clothing which thereby tends to reduce the length of the material at the point of the tied portion. As shown in FIG. 5, this may be accomplished in many different ways, FIG. 5 illustrating an embodiment where two tied portions 120 and 122 are provided in a row and thereafter a looped portion 124 or 126 may be provided. Such a decision may be based on the desirability of an aesthetic feature or the necessity of drawing in the garment material at a particular point.

In accordance with the article aspects of the present invention, there is thus an article of clothing which is altered by the paired strips which are formed adjacent to one another in the material and being tied in a knot for shortening in dimension of the garment at a preselected location.

Thus, in operation, the cloth or material to which a clothing may be made out of may be altered prior to making the article of clothing, or as shown in the drawing, an article of clothing may be altered to provide certain advantageous features. Thus, by the methods of the present invention the arm portions 16 could either be shortened, as shown generally at 36, or the circumference of the arms may be narrowed, as shown generally at 38. Similarly, the waist 18 of the garment may be "taken in", in an aesthetically pleasing manner, as shown at portions 40.

It will be readily appreciated by those skilled in the art that the above invention may be utilized in sweat shirts, vests, shirts, pants and other garments, as may be desirable, to a final consumer. Thus, with the methods and articles of the present invention, an altered garment is produced which has customized dimensions and also produces a modern styled garment.

While the above description constitutes the preferred embodiment of the present invention, it is to be appreciated that the invention is susceptible to modification, variation and change without departing from the proper scope and the fair meaning of the accompanying claims.

What is claimed is:

1. A method of altering an article of clothing made from a sheet of material comprising the steps of:

(a) making at least two cuts into the material for forming a strip of material of a predetermined length attached at both ends to the material;

(b) cutting the strip to form a pair of strips having free ends; and (c) reattaching the pair of strips together to form an altered article of clothing.

2. The method of claim 1 wherein greater than two cuts are made in step (a) to form a plurality of strips of material which may each be cut and tied.

3. The method of claim 1 wherein step (c) is accomplished by tying the strips together.

4. The method of claim 2 wherein every other strip is cut and tied in a knot.

5. The method of claim 3 wherein a square knot is used to tie the pair of strips together.

6. The method of claim 4 wherein every other strip is cut and tied in a square knot.

7. A method of altering an article of clothing made from a sheet of material comprising the steps of:

(a) folding a portion of the material upon itself;

(b) making at least two spaced cuts into the material for forming a strip of material of a predetermined length attached at both ends to the material;

(c) cutting the strip to form a pair of strips having free ends; and (d) tying a knot with the free ends of the strip to form the altered article of clothing.

8. The method of claim 7 wherein greater than two cuts are made in step (a) to form a plurality of strips of material which may each be cut and tied.

9. The method of claim 8 wherein every other strip is cut and tied in a knot.

10. The method of claim 7 wherein a square knot is used to tie the pair of strips together.

11. The method of claim 7 wherein every other strip is cut and tied in a square knot.

12. An altered article of clothing comprising:

a body of material for forming the article of clothing;

a pair of strips formed adjacent one another in said material, said strips being tied in a knot for shortening a dimension of the article of clothing at a preselected location.

13. The altered article of clothing of claim 12 further comprising a plurality of said pair of strips tied together.

14. The altered article of clothing of claim 13 wherein said garment further comprises a sweat shirt having a sleeve, wherein the length of said sleeve is shortened by providing a plurality of said pair of strips extending in an axial direction of said sleeve spaced about the circumference of said sleeve for shortening of said sleeve.

15. The altered article of clothing of claim 14 wherein the garment further comprises a sweat shirt having a waist portion wherein the dimension of the waist is reduced by providing a plurality of said pair of strips extending in a non-circumferential direction for taking in the dimension of the waist.

* * * * *